US007022441B2

(12) United States Patent
Maskasky et al.

(10) Patent No.: US 7,022,441 B2
(45) Date of Patent: Apr. 4, 2006

(54) SILVER-FREE BLACK-AND-WHITE THERMOGRAPHIC MATERIALS CONTAINING A BENZOQUINONE AND METHODS OF IMAGING

(75) Inventors: Joe E. Maskasky, Rochester, NY (US); Victor P. Scaccia, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 163 days.

(21) Appl. No.: 10/786,794

(22) Filed: Feb. 25, 2004

(65) Prior Publication Data

US 2005/0186518 A1 Aug. 25, 2005

(51) Int. Cl.
*G03C 3/00* (2006.01)
*G03C 7/00* (2006.01)

(52) U.S. Cl. ..... 430/17; 430/3; 430/203; 430/250; 430/332; 430/343; 430/541; 430/549; 430/955; 430/957; 430/964; 552/293; 568/31

(58) Field of Classification Search ..... 430/3, 430/17, 350, 203, 250, 332, 343, 541, 549, 430/559, 955, 957, 964, 966; 568/31; 552/293
See application file for complete search history.

(56) References Cited

U.S. PATENT DOCUMENTS 2,899,334 A * 8/1959 Crevling et al. ..... 430/644
2,967,784 A 1/1961 Newman et al.
2,995,465 A 8/1961 Richey, Jr.
3,080,254 A 3/1963 Grant, Jr.
3,515,568 A * 6/1970 Goldman et al. ..... 430/19
3,847,612 A 11/1974 Winslow
4,123,282 A 10/1978 Winslow
4,277,558 A * 7/1981 Kikuchi et al. ..... 430/542
4,409,315 A * 10/1983 Armour et al. ..... 430/214
4,485,164 A * 11/1984 Armour et al. ..... 430/214
5,266,448 A * 11/1993 Shuto et al. ..... 430/379
5,599,647 A 2/1997 Defieuw et al.
5,858,583 A * 1/1999 Dessauer et al. ..... 430/17
6,146,822 A 11/2000 Asanuma et al.
6,593,069 B1 7/2003 Oya et al.
2002/0018944 A1 2/2002 Irving et al.
2002/0018967 A1 2/2002 Irving et al.

FOREIGN PATENT DOCUMENTS

EP 0 924 098 B1 5/2002
EP 1 270 255 A1 1/2003

OTHER PUBLICATIONS

U.S. Appl. No. 10/786,852, filed herewith, Maskasky et al., titled Black-And-White Thermographic Materials With Improved Image Tone.
U.S. Appl. No. 10/786,851, filed herewith, Maskasky et al., titled Silver-Free Black-And-White Thermographic Materials.
U.S. Appl. No. 10/786,827, filed herewith, Maskasky et al., titled Black-And-White Thermographic Material Containing Dye-Forming Chemistry.

* cited by examiner

*Primary Examiner*—Amanda Walke
(74) *Attorney, Agent, or Firm*—J. Lanny Tucker

(57) ABSTRACT

Silver-free, aqueous-based direct thermographic materials are designed to have image tone with near neutral density. Without the use of organic silver salts containing reducible silver ions, the image is formed using a color developing agent precursor that releases a color developing agent when heated to a temperature of at least 80° C., a combination of cyan, yellow and magenta dye-forming color couplers that provide cyan, yellow, and magenta dyes, and a substituted or unsubstituted benzoquinone as an oxidizing agent. No silver metal or silver ions are purposely added to these materials. This combination of components provides a means for controlling image tone without reliance upon conventional toning agents.

18 Claims, No Drawings

SILVER-FREE BLACK-AND-WHITE THERMOGRAPHIC MATERIALS CONTAINING A BENZOQUINONE AND METHODS OF IMAGING

FIELD OF THE INVENTION

This invention relates to silver-free black-and-white thermographic materials ("direct thermal" materials) that can provide images having improved tone from the incorporation of color dye-forming couplers, blocked color developing agents, and certain benzoquinone oxidizing agents. This invention also relates to methods of imaging using these thermographic materials.

BACKGROUND OF THE INVENTION

Silver-containing thermographic imaging materials ("direct thermal" materials) are non-photosensitive materials that are used in a recording process wherein images are generated by the direct application of thermal energy. These materials have been known in the art for many years and generally comprise a support having disposed thereon one or more imaging layers comprising (a) a relatively or completely non-photosensitive source of reducible silver ions, (b) a reducing composition (usually including a developer) for the reducible silver ions, and (c) a suitable hydrophilic or hydrophobic binder. Thermographic materials are sometimes called "direct thermal" materials in the art because they are directly imaged by a source of thermal energy without any transfer of the energy or image from another material.

In a typical thermographic construction, the image-forming layers are based on silver salts of long chain fatty acids. The preferred non-photosensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent whereby a black-and-white image of elemental silver is formed.

Problem to be Solved

Thermographic materials are imaged by contacting them with the thermal head of a thermographic recording apparatus such as a thermal printer or thermal facsimile to form a visible image (usually a black-and-white image). Heat generated in the thermal print head can range from 100 to many hundreds of ° C. Because the contact between the thermal print head and a given area of the thermographic material is very short (a few milliseconds), the thermographic material never reaches the same temperature as the thermal print head.

It is difficult to generate a "neutral" black-and-white silver image in such materials due to the strong dependence of image tone on silver particle size and shape. Typically, the silver image tends to have a yellowish tint. Thus, a fine balancing of toning agents ("toners") and other components (such as reducing agents and development accelerators) is necessary to provide a desired "neutral" image tone but even then the image tone can change depending upon imaging conditions (that is, temperature and time). The use of toning agents to adjust image tone in thermally developable materials is a common practice as described in early literature such as U.S. Pat. No. 3,080,254 (Grant, Jr.), U.S. Pat. No. 3,847,612 (Winslow), and U.S. Pat. No. 4,123,282 (Winslow), and in more recent publications of which there are hundreds with U.S. Pat. No. 5,599,647 (Defieuw et al.) and U.S. Pat. No. 6,146,822 (Asanuma et al.) and EP 1,270,255 (Dooms et al.) being representative.

There is a need for better and more predictable control of image tone in thermographic materials that can be imaged under a variety of conditions without the use of silver imaging components.

SUMMARY OF THE INVENTION

This invention provides a silver-free, black-and-white thermographic material comprising a support having thereon at least one imaging layer comprising predominantly a hydrophilic or water-dispersible polymeric latex binder, and further comprising:

a) a color developing agent precursor that releases a color developing agent when heated to a temperature of at least 80° C., and b) a cyan dye-forming color coupler that is capable of reacting with the released color developing agent to produce a cyan dye, c) a magenta dye-forming color coupler that is capable of reacting with the released color developing agent to produce a magenta dye, d) a yellow dye-forming color coupler that is capable of reacting with the released color developing agent to produce a yellow dye, and e) an oxidizing agent that is a benzoquinone that is capable of oxidizing the released color developing agent, the material being substantially free of silver metal or reducible silver ions.

In preferred embodiments, this invention provides a silver-free, black-and-white, non-photosensitive thermographic material that comprises a transparent polymer support having on only one side thereof one or more thermally sensitive imaging layers and an outermost non-thermally sensitive protective layer over the one or more thermally sensitive imaging layers, the one or more thermally sensitive imaging layers comprising predominantly one or more hydrophilic binders, and in reactive association, imaging chemistry consisting essentially of:

a) a color developing agent precursor that releases a p-phenylenediamine color developing agent when heated to a temperature of at least 80° C., the color developing agent precursor being present in an amount of from about 0.001 to about 0.05 mol/m$^2$, b) a cyan dye-forming color coupler that is capable of reacting with the released color developing agent to produce a cyan dye, c) a magenta dye-forming color coupler that is capable of reacting with the released color developing agent to produce a magenta dye, d) a yellow dye-forming color coupler that is capable of reacting with the released color developing agent to produce a magenta dye, and e) an oxidizing agent that is benzoquinone, tetrachloro-1,4-benzoquinone, 2,6-dimethoxy-1,4-benzoquinone, or 2,3,5-trichloro-6-pentadecyl-1,4-benzoquinone and is present in an amount of from about 1 to about 10 mol/mol of the color developing agent precursor, the material being substantially free of silver metal or reducible silver ions, and the cyan dye-forming color coupler, magenta dye-forming color coupler, and yellow dye-forming color coupler being independently present in an amount from about 0.05 to about 0.5 mol/mol of the color developing agent precursor.

This invention also provides a method comprising imaging the thermographic material of the present invention with a thermal imaging source to provide a visible image.

This method can further include using the imaged thermographic material for medical diagnostic purposes.

When direct thermographic materials are imaged using thermal energy, the conventional components of reducing agent, non-photosensitive silver salt, and toning agents react to form a silver image that may not have the desired color tint or hue (or image tone). However, in the materials of this invention, the blocked color developing agent precursor and dye-forming color couplers provide a combination of cyan, yellow, magenta dyes in appropriate amounts so as to modify the tone of the resulting image. No silver (or silver ions) and conventional black-and-white developer or reducing agents are present. The released color developing agent is oxidized by the benzoquinone oxidizing agent. The oxidized color developing agent then reacts with the color couplers to provide appropriate cyan, yellow, and magenta dyes. The resulting image is more nearly neutral in overall density, meaning that the overall red, blue, and green densities are close to each other. The overall density may be designed to be slightly "blue" in color (i.e., a lower blue density relative to the red and green densities) since users may prefer a bluish-black background for viewing the images.

Thus, the present invention provides a more convenient means for adjusting or controlling image tone without the need to use silver imaging components or conventional toning agents of the type that significantly modify silver image tone.

The thermographic materials of this invention comprise a transparent support having thereon an aqueous-based imaging layer(s) comprising predominantly hydrophilic binders such as gelatin or a gelatin derivative, and optionally an aqueous-based or solvent-based overcoat serving as a surface protective or "slip" layer. Thus, the embodiments of this invention are coated out of aqueous-based formulations.

DETAILED DESCRIPTION OF THE INVENTION

The direct thermographic materials of this invention can be used to provide black-and-white images using dye-forming color couplers, blocked color developing agents, benzoquinone oxidizing agents, hydrophilic binders, and other components known to be useful in such materials. No silver or silver ions (such as from organic silver salts) are purposely added to the materials.

The direct thermographic materials of this invention can be used in black-and-white thermography and in electronically generated black-and-white hardcopy recording. They can be used as output media, in radiographic imaging (for example digital medical imaging), X-ray radiography, and in industrial radiography.

The direct thermographic materials of this invention are particularly useful as output media for medical imaging of human or animal subjects in response to thermal imaging means. Such applications include, but are not limited to, thoracic imaging, mammography, dental imaging, orthopedic imaging, general medical radiography, therapeutic radiography, veterinary radiography, and auto-radiography.

In the direct thermographic materials of this invention, the components needed for imaging can be in one or more thermally sensitive layers on one side ("frontside") of the support. The layer(s) that contain the color developing agent precursor, oxidizing agents, and color couplers are referred to herein as thermographic emulsion layer(s) or thermally sensitive imaging layer(s).

Where the materials contain thermographic imaging layers on one side of the support only, various non-imaging layers can be disposed on the "backside" (non-emulsion or non-imaging side) of the materials including an outermost slip layer and/or a conductive layer.

In such embodiments, various non-imaging layers can also be disposed on the "frontside," imaging, or emulsion side of the support, including primer layers, interlayers, opacifying layers, subbing layers, carrier layers, antihalation layers, "slip" (or protective) layers, auxiliary layers, and other layers readily apparent to one skilled in the art.

For some embodiments, the direct thermographic materials may be "double-sided" or "duplitized" and have thermographic emulsion coating(s) or thermally sensitive imaging layer(s) on both sides of the support. In such constructions each side can also include one or more primer layers, interlayers, antistatic layers, auxiliary layers, conductive layers, "slip" (or protective) layers, and other layers readily apparent to one skilled in the art.

Definitions

As used herein:

In the descriptions of the thermographic materials of the present invention, "a" or "an" component refers to "at least one" of that component (for example, a color developing agent precursor or color coupler).

"Thermographic material(s)" means a construction comprising at least one thermographic emulsion layer or thermally sensitive imaging layer(s) wherein the required components or optional additives are distributed, as desired, in the same layer or in adjacent coated layers, as well as any supports, topcoat layers, image-receiving layers, carrier layers, blocking layers, conductive layers, antihalation layers, subbing or priming layers. These materials include multilayer constructions in which one or more imaging components are in different layers, but are in "reactive association". Thus, one layer can include the color developing agent precursor and another layer can include the oxidizing agent, but the two reactive components are in reactive association with each other.

When used in thermography, the term, "imagewise exposing" or "imagewise exposure" means that the material is imaged using any means that provides an image using heat. This includes, for example, analog exposure where an image is formed by differential contact heating through a mask using a thermal blanket or infrared heat source, as well as by digital exposure where the image is formed one pixel at a time such as by modulation of thermal print-heads or laser imaging sources.

The materials of this invention are "direct" thermographic materials used in "direct thermal transfer" in which imaging is either "on" or "off" (bimodal), and thermal imaging is carried out in a single "element" containing all of the necessary imaging chemistry. Direct thermal imaging is distinguishable from what is known in the art as thermal transfer imaging (such as dye transfer imaging) in which the image is produced in one element ("donor") and transferred to another element ("receiver") using thermal means.

"Catalytic proximity" or "reactive association" means that the components are in the same layer or in adjacent layers so that they readily come into contact with each other during thermal imaging and development.

"Emulsion layer," "imaging layer," or "thermographic emulsion layer," means a thermally sensitive layer of a thermographic material that contains the color developing agent precursor. It can also mean a layer of the thermographic material that contains, in addition to this component, additional required components or optional additives. These layers are usually on what is known as the "frontside" of the support.

The slip layer is generally the outermost layer on the imaging side of the material that is in direct contact with the imaging means.

Many of the chemical components used herein are provided as a solution. The term "active ingredient" means the amount or the percentage of the desired material contained in a sample. All amounts listed herein are the amount of active ingredient added unless otherwise specified.

"Ultraviolet region of the spectrum" refers to that region of the spectrum less than or equal to 410 nm, and preferably from about 100 nm to about 410 nm. "Visible region of the spectrum" refers to that region of the spectrum of from about 400 nm to about 700 nm. "Infrared region of the spectrum" refers to that region of the spectrum of from about 700 nm to about 1400 nm.

"Non-photosensitive" means not intentionally light sensitive. The direct thermographic materials of the present invention are non-photosensitive meaning that no photosensitive silver halide(s) has been purposely added.

The sensitometric terms, absorbance, contrast, $D_{min}$, and $D_{max}$ have conventional definitions known in the imaging arts. In thermographic materials, $D_{min}$ is considered herein as image density in the non-thermally imaged areas of the thermographic material. The sensitometric term absorbance is another term for optical density (OD).

"Transparent" means capable of transmitting visible light or imaging radiation without appreciable scattering or absorption.

The terms "double-sided", "double-faced coating", or "duplitized" are used to define thermographic materials having one or more of the same or different imaging layers disposed on both sides (front and back) of the support.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. Also, an alkyl group can include ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art.

*Research Disclosure* is a publication of Kenneth Mason Publications Ltd., Dudley House, 12 North Street, Emsworth, Hampshire PO10 7DQ England. It is also available from Emsworth Design Inc., 147 West 24th Street, New York, N.Y. 10011.

Other aspects, advantages, and benefits of the present invention are apparent from the detailed description, examples, and claims provided in this application.

Color Developing Agent Precursors and Dye-Forming Color Couplers

The present invention uses one or more color developing agent precursors in the thermographic materials. By "precursor" is meant that the compounds are capable of releasing a compound that is a color developing agent when heated to a temperature of at least 80° C. Such precursor compounds may also be described as "blocked" color developing agents that become "unblocked" or reactive upon heating to the appropriate temperature. The released color developing agents can be any of those known in the art for providing color images in color photographic materials including but not limited to, aminophenols, p-phenylenediamines (especially N,N-dialkyl-p-phenylenediamines) and others which are well known in the art, such those described in EP 0 434 097A1 (published Jun. 26, 1991) and EP 0 530 921A1 (published Mar. 10, 1993). It may be useful for the released color developing agents to have one or more water-solubilizing groups as are known in the art. Further details of such materials are provided in *Research Disclosure*, publication 38957, pages 592–639 (September 1996). The color developing agent precursors then have an appropriate "blocking" group that prohibits there reaction with a dye-forming color coupler until the color developing agent is released during thermal imaging. Useful blocking groups would be readily apparent to one skilled in the art.

Representative color developing agent precursors are described in several publications including U.S. Patent Publication 2002/0018967 (Irving et al.), incorporated herein by reference for the compounds described in paragraphs 0143 through 0228 including the specific compounds identified as D-1 through D-46. Methods of making these compounds are also described in the art. Particularly useful color developing agent precursors are identified below for the Examples as CDA-1, CDA-2, CDA-3, CDA-4, and CDA-5.

The one or more color developing agent precursors are present in an amount of from about 0.0001 to about 0.1 mol/m$^2$ and preferably in an amount of from about 0.001 to about 0.05 mol/m$^2$.

The photothermographic materials of this invention also include a combination of one or more magenta dye-forming color couplers, one or more yellow dye-forming color couplers, and one or more cyan dye-forming color couplers to provide the desired neutral images described herein. Any convenient cyan, yellow, and magenta dye-forming color couplers can be employed as would be determined by a skilled worker in the art through routine experimentation to determine how much of what color couplers would improve the desired neutral image tone. In general, the amount of such dye-forming couplers is from about 0.01 to about 1 mol and preferably from about 0.05 to about 0.5 mol, per mole of color developing agent precursor, independently for the cyan dye-forming color couplers, yellow dye-forming color couplers, and the magenta dye-forming color couplers.

Conventional dye forming couplers are described in considerable publications too numerous to mention including *Research Disclosure*, Number 389, Item 38957, Section X. Dye image formers and modifiers, B. Image-dye-forming couplers, publications noted therein. Representative cyan dye-forming color couplers are described in U.S. Pat. No. 5,453,348 (Kuse et al.). Examples of useful cyan dye-forming color couplers include compounds having a naphthol or phenol structure and that form indoaniline dyes via the coupling reaction with a color developing agent. Representative examples of magenta dye-forming color couplers include compounds having a 5-pyrazolone ring with an active methylene group and pyrazoloazole compounds. Representative examples of yellow dye-forming color couplers have benzoylacetoanilide, pivalylacetoanilide, and acylacetoanilide structures containing active methylene rings. Both 2-equivalent and 4-equivalent dye-forming color couplers can be used. Methods of making useful color couplers are well known in the extensive literature on this subject.

Particularly useful dye-forming color couplers are identified below for the Examples as C-1 (cyan), M-1 (magenta), and Y-1 (yellow).

Oxidizing Agents

The thermographic materials also include one or more oxidizing agents that are substituted or unsubstituted benzoquinones. These compounds are capable of oxidizing the released color developing agent. These compounds can be water-insoluble, water-dispersible, or water-soluble, but water-dispersible compounds may be desirable in the aqueous formulations used to make the materials of the present invention.

Useful benzoquinones can be represented by the following Structure I:

(I)

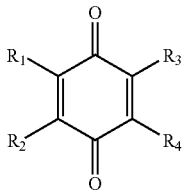

wherein $R_1$, $R_2$, $R_3$, and $R_4$ are independently (same or different) hydrogen, or electron accepting or electron withdrawing groups. The compounds of Structure I can have a mixture of electron-accepting and electron-withdrawing groups as substituents. Preferably, one or more groups are electron-withdrawing because compounds with such group tend to have little or no absorption of visible light.

For example, $R_1$, $R_2$, $R_3$, and $R_4$ are independently hydrogen, substituted or unsubstituted alkyl groups, substituted or unsubstituted aryl groups, substituted or unsubstituted cycloalkyl groups, substituted or unsubstituted alkoxy or aryloxy groups, cyano, halo, sulfo, sulfonamido, carbonamido, or carboxy groups.

Such alkyl groups can have 1 to 20 carbon atoms and can be branched or linear (such as methyl, ethyl, iso-propyl, t-butyl, n-hexyl, dodecyl, benzyl, and methoxymethyl groups). Such aryl groups have 6 or 10 carbon atoms in the aromatic ring and can be substituted with one or more alkyl or alkoxy groups (for example, phenyl, naphthyl, 3-methoxyphenyl, and 2,4-dimethylphenyl groups). The cycloalkyl groups have 5 to 10 carbon atoms in the ring structure [such as cyclopentyl, cyclohexyl, dimethylcyclohexyl, and 2,4-di(t-butyl)cyclohexyl groups]. The alkoxy groups can have 1 to 20 carbon atoms (such as methoxy, 2-ethoxy, n-propoxy, and t-butoxy groups). The aryloxy groups can be similarly defined as the aryl groups attached through an oxy group.

Alternatively, either $R_1$ and $R_2$ or $R_3$ and $R_4$ can be combined to form a carbocyclic or heterocyclic ring (including fused ring systems) that can be further substituted with a variety of substituents that do not interfere with the oxidizing capacity of the compounds.

Preferably, $R_1$, $R_2$, $R_3$, and $R_4$ are independently hydrogen, substituted or unsubstituted alkyl groups having 1 to 4 carbon atoms, substituted or unsubstituted cyclohexyl groups, substituted or unsubstituted phenyl groups, or halo groups (such as chloro groups). More preferably, they are independently hydrogen, chloro, unsubstituted methyl, ethyl, cyclohexyl, or phenyl groups.

Specific examples of useful benzoquinones are benzoquinone, tetrachloro-1,4-benzoquinone, 2,6-dimethoxy-1,4-benzoquinone, and 2,3,5-trichloro-6-pentadecyl-1,4-benzoquinone. Mixtures of these compounds can also be used.

The one or more oxidizing agents are present in the thermographic materials in an amount of from about 0.5 to about 20 mol, and preferably from about 1 to about 10 mol, per mol of the color developing agent precursor in the materials.

These oxidizing agents can be obtained from several commercial sources including Aldrich Chemical Company or they can be prepared using known synthetic procedures and starting materials.

Other Addenda

The direct thermographic materials of this invention can also contain other additives such shelf-life stabilizers, contrast enhancers, dyes or pigments, post-processing stabilizers or stabilizer precursors, thermal solvents (also known as melt formers), and other image-modifying or development-modifying agents as would be readily apparent to one skilled in the art. Toning agents that are commonly used in the art to modify image tone of the reduced silver are not necessary in the practice of this invention because image tone is controlled by the dyes generated from the dye-forming color couplers. However, toning agents that accelerate development and/or increase image density may be useful.

Suitable stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles as described in U.S. Pat. No. 3,287,135 (Anderson), sulfocatechols as described in U.S. Pat. No. 3,235,652 (Kennard), oximes as described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during imaging can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles may be used as stabilizing compounds as described in U.S. Pat. No. 6,171,767 (Kong et al.) and U.S. Pat. No. 6,083,681 (Lynch et al.).

The direct thermographic materials of this invention may also include one or more thermal solvents (or melt formers) as disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

Binders

The color developing agent precursor, dye-forming color couplers, benzoquinone oxidizing agents, and any optional additives used in the present invention are generally mixed with one or more hydrophilic binders to form an aqueous-based coating formulation. Water-dispersible polymer latex binders can also be used.

Thus, the binders are predominantly (at least 50% by weight of total binders) hydrophilic in nature and aqueous solvent-based formulations are used to prepare such thermographic materials. Mixtures of hydrophilic binders can also be used.

Examples of useful hydrophilic binders that can be used include proteins and protein derivatives, gelatin and gelatin-like derivatives (hardened or unhardened), cellulosic materials, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides, and other synthetic or naturally occurring vehicles commonly known for use in aqueous-based imaging emulsions.

Water-dispersible binders including water-dispersible polymer latexes can also be used in place of some of all of the hydrophilic binders in the thermographic materials of this invention. Such materials are well known in the art including U.S. Pat. No. 6,096,486 (noted above).

In some embodiments, hydrophobic binders can be used as long as they comprise less than 50 weight % of total binder weight. Examples of useful hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available as BUTVAR® B79 (Solutia, Inc.) and PIOLOFORM® BS-18 or PIOLOFORM® BL-16 (Wacker Chemical Company) and cellulose ester polymers.

The polymer binder(s) is used in an amount sufficient to carry the components dispersed therein. Generally, one or more binders are used at a level of about 10% by weight to about 90% by weight (more preferably at a level of about 20% by weight to about 70% by weight) based on the total dry weight of the layer in which it is included.

Support Materials

The thermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal imaging and development and to have suitable adhesive properties with overlying layers. Useful polymeric materials for making such supports include polyesters, cellulose acetate and other cellulose esters, polyvinyl acetal, polyolefins, polycarbonates, and polystyrenes. Preferred supports are composed of polyesters and polycarbonates.

Support materials can contain various colorants, pigments, and antihalation or acutance dyes if desired. For example, the support can contain conventional blue dyes that differ in absorbance from colorants in the various frontside or backside layers as described in U.S. Pat. No. 6,248,442 (Van Achere et al.). Support materials may be treated using conventional procedures (such as corona discharge) to improve adhesion of overlying layers, or subbing or other adhesion-promoting layers can be used, or treated or annealed to promote dimensional stability.

The thermographic materials preferably have an outermost slip or protective layer on at least the imaging side of the support comprising useful components such as one or more specific lubricants and/or matting agents that are known in the art. The matting agents can be composed of any useful material and may have a size in relation to the slip layer thickness that enables them to protrude through the outer surface of the conductive layer, as described for example, in U.S. Pat. No. 5,536,696 (Horsten et al.). Particularly useful combinations of lubricants are described in copending and commonly assigned U.S. Ser. No. 10/767,757 (filed on Jan. 28, 2004 by Kenney, Foster, and Johnson) that is incorporated herein by reference.

Thermographic Formulations

An aqueous-based formulation is made in an aqueous solvent that comprises at least 50 volume % water. Some of the components may not be water-soluble and thus may need to be dispersed in organic solvents that are miscible with the solvent used to make the formulation.

The thermographic materials of this invention can be constructed of two or more layers on the imaging side of the support. Two-layer materials would include a single imaging layer and an outermost protective layer. The single imaging layer would contain all of the components needed for imaging, those components desired for the present invention, as well as optional materials such as toning agents, development accelerators, thermal solvents, coating aids, and other additives.

Layers or polymeric materials to promote adhesion in thermographic materials are described for example in U.S. Pat. No. 5,891,610 (Bauer et al.), U.S. Pat. No. 5,804,365 (Bauer et al.), U.S. Pat. No. 4,741,992 (Przezdziecki), and U.S. Pat. No. 5,928,857 (Geisler et al.).

Layers to reduce emissions from the film may also be present as described in U.S. Pat. No. 6,352,819 (Kenney et al.), U.S. Pat. No. 6,352,820 (Bauer et al.), and U.S. Pat. No. 6,420,102 (Bauer et al.), and in copending and commonly assigned U.S. Ser. No. 10/351,814 (filed Jan. 27, 2003 by Hunt), all incorporated herein by reference.

Layer formulations described herein can be coated by various coating procedures including wire wound rod coating, dip coating, air knife coating, curtain coating, slide coating, or extrusion coating. The formulations can be coated one at a time, or two or more formulations can be coated simultaneously by the procedures described in the art.

When the layers are coated simultaneously using various coating techniques, a "carrier" layer formulation comprising a single-phase mixture of the two or more polymers described above may be used as described in U.S. Pat. No. 6,436,622 (Geisler), incorporated herein by reference.

Preferably, two or more layers are applied to a film support using slide coating with the first layer coated on top of the second layer while the second layer is still wet using the same or different solvents (or solvent mixtures).

While the first and second layers can be coated on one side of the film support, manufacturing methods can also include forming one or more layers on the opposing or backside of said polymeric support.

Preferred embodiments include a conductive layer on one or both sides of the support, and more preferably on the backside of the support. Various conductive materials are known in the art such as soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), electroconductive underlayers as described in U.S. Pat. No. 5,310,640 (Markin et al.), and electrically-conductive metal-containing particles dispersed in a polymeric binder as described in EP 0 678 776A1 (Melpolder et al.). In addition, fluorochemicals such as Fluorad® FC-135 (3M Corporation), ZONYL® FSN (E.I. DuPont de Nemours & Co.), as well as those described in U.S. Pat. No. 5,674,671 (Brandon et al.), U.S. Pat. No.

6,287,754 (Melpolder et al.), U.S. Pat. No. 4,975,363 (Cavallo et al.), U.S. Pat. No. 6,171,707 (Gomez et al.), and in copending and commonly assigned U.S. Ser. No. 10/107,551 (filed Mar. 27, 2002 by Sakizadeh, LaBelle, Orem, and Bhave) and U.S. Ser. No. 10/265,058 (filed Oct. 10, 2002 by Sakizadeh, LaBelle, and Bhave) can be used.

In preferred embodiments, the conductive layer includes one or more specific non-acicular metal antimonate particles such as non-acicular metal antimonate particles composed of $ZnSb_2O_6$.

Imaging/Development

The direct thermographic materials of the present invention can be imaged in any suitable manner consistent with the type of material using any suitable source of thermal energy. The image may be "written" simultaneously with development at a suitable temperature using a thermal stylus, a thermal print head, or a laser, or by heating while in contact with a heat-absorbing material. The thermographic materials may include a dye (such as an IR-absorbing dye) to facilitate direct development by exposure to laser radiation.

The following examples are provided to illustrate the practice of the present invention and the invention is not meant to be limited thereby.

MATERIALS AND METHODS FOR THE EXAMPLES

CDA-1

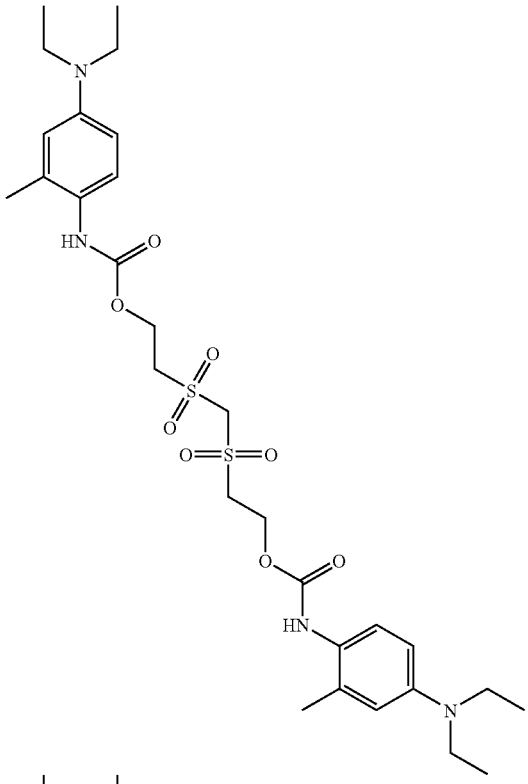

CDA-2

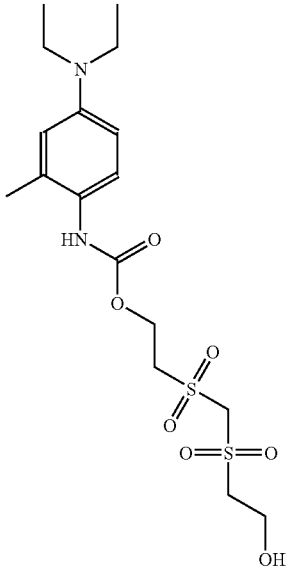

CDA-3

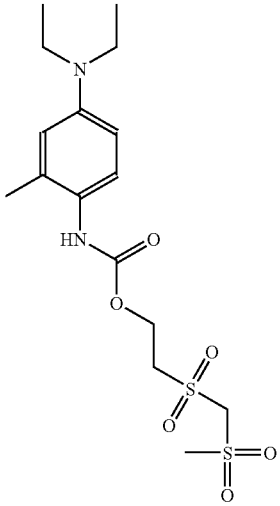

-continued
CDA-4
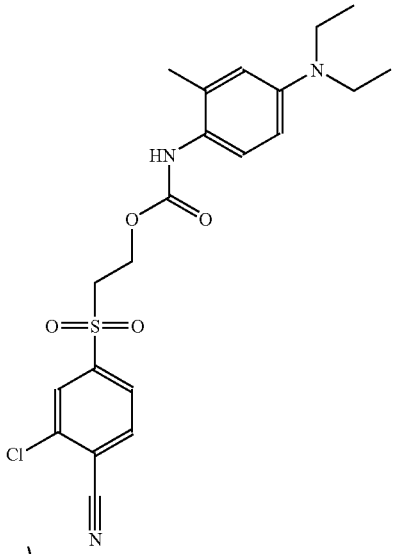
CDA-5
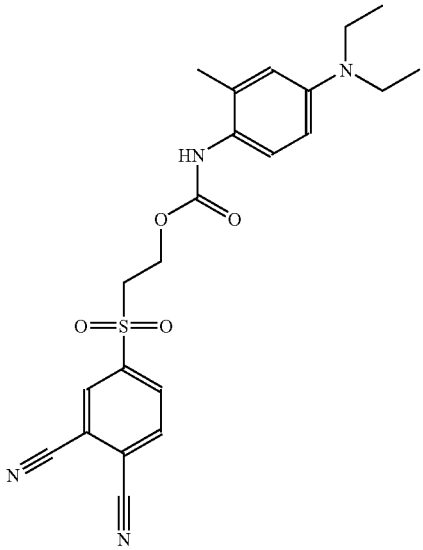
C-2
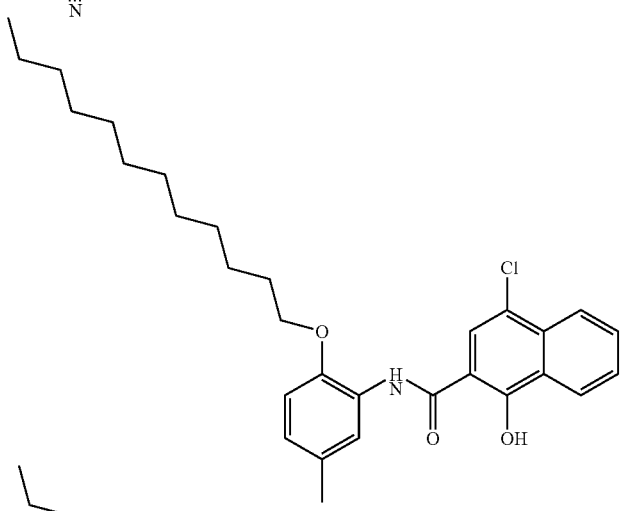
M-1
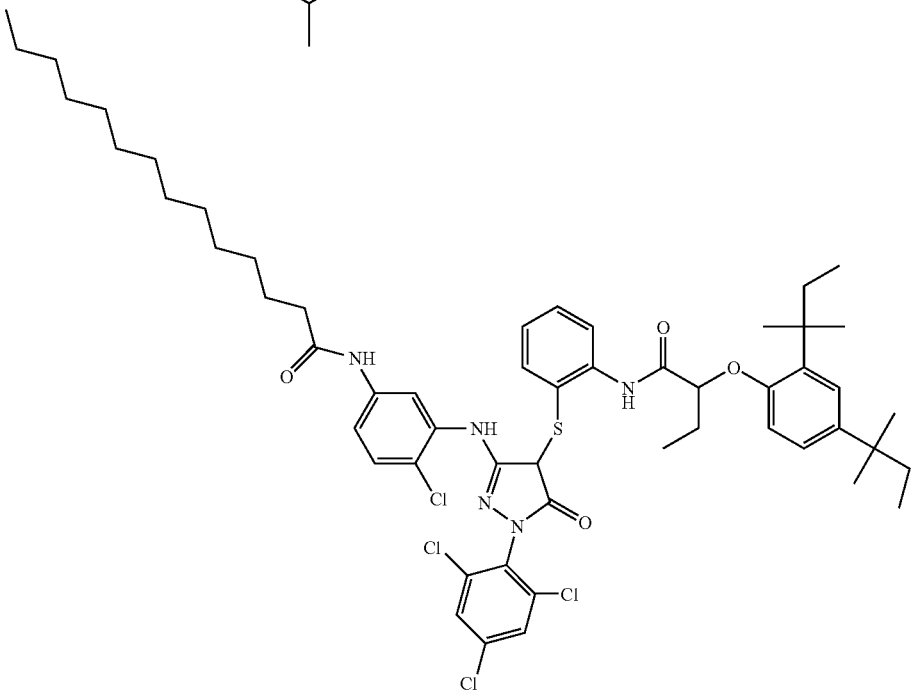

-continued

C-1

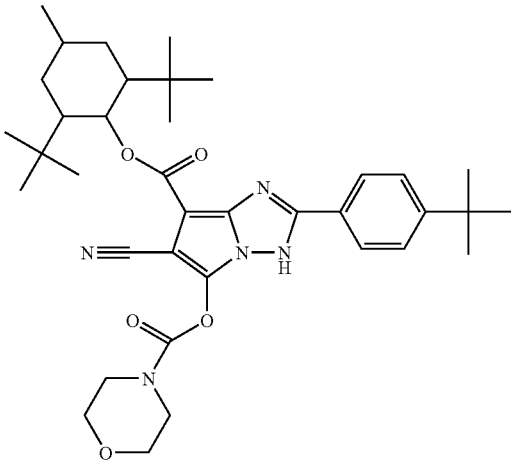

Y-1

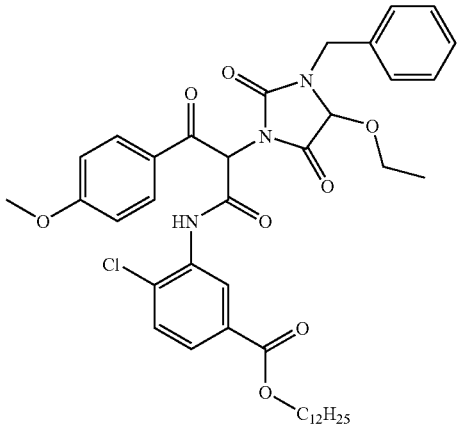

Cyan-1 Coupler Dispersion:

A cyan dye forming coupler dispersion was prepared containing 5 weight % of C-1, 5 weight % of tri(methylphenyl)phosphate (KS1) coupler solvent, and 6 weight % of gelatin using conventional techniques.

Magenta-1 Coupler Dispersion:

A magenta dye forming coupler dispersion was prepared containing 6.8 weight % of M-1, 6.8 weight % of KS1 coupler solvent, and 7.8 weight % of gelatin using conventional techniques.

Yellow-1 Coupler Dispersion:

A yellow dye forming coupler dispersion was prepared containing 9.0 weight % of Y-1, 4.5 weight % of KS1 coupler solvent, and 9 weight % of gelatin using conventional techniques.

Color Developing Agent Precursor Dispersion (Dispersion-1):

A solid particle dispersion of color developing agent precursor was prepared containing 13.2 weight % of CDA-1 and 4 weight % of gelatin.

HAR1 Hardener Solution:

A hardener composition was prepared containing 2.7 weight % of bis(vinylsulfonyl)methane (BVSM).

SA Dispersion:

This was a 25 weight % solid particle dispersion of salicylanilide.

Oxidizing Agent 1 Dispersion:

A solid particle oxidizing agent dispersion of 2,3,5-trichloro-6-pentadecyl-2,5-cyclohexadiene-1,4-dione (10.68 weight %) was prepared by milling the compound, water, and Olin 10G nonionic surfactant (10 weight % of oxidant) for 6 days.

Oxidizing Agent 2 Dispersion:

A solid particle oxidizing agent dispersion of tetrachloro-1,4-benzoquinone (11.69 weight %) was prepared by milling the compound, water, and Olin 10G nonionic surfactant (10 weight % of oxidant) for 6 days.

Oxidizing Agent 3 Dispersion:

A solid particle oxidizing agent dispersion of 2,6-dimethoxy-1,4-benzoquinone (10.91 weight %) was prepared by milling the compound, water, and Olin 10G nonionic surfactant (10 weight % of oxidant) for 6 days.

The color densities, both before and after processing are shown in TABLE I provided below. The red, green, and blue densities were measured using Status A densitometry having spectral measuring peaks at 450 nm (for blue density), 550 nm (for green density), and 625 nm (for red density), respectively, using a Macbeth TD504 densitometer and the appropriate filters (see T. H. James, *The Theory of the Photographic Process,* $4^{th}$ Ed., Macmillan Publishing Co., Inc., N.Y., 1977, page 521 for details of this process). As the red, green, and blue densities are closer to each other, the more "neutral" are the images. It may be desirable to have a small "spread" but not necessarily zero spread depending on the image tone required for a specific imaging material. For example, a little higher blue density could be desirable for some medical films since medical professionals generally prefer to view images in bluish films. It is also desired that the three color densities be high.

EXAMPLE 1 (INVENTION)

A direct thermographic material of the present invention was prepared in the following manner:

To 3.4 g of deionized water, with stirring at 40° C., 1.24 g of oxidized deionized bone gelatin, 6.88 g of Oxidizing Agent 1 Dispersion, 1.58 g of Cyan-1 Coupler Dispersion, 1.30 g of Magenta-1 Coupler Dispersion, 2.92 g of Yellow-1 Coupler Dispersion, and 0.2 ml of 6.8 weight % SDS solution, were added. The resulting mixture was adjusted to pH 7.0 with a sodium hydroxide solution. Just prior to coating, 5.55 g of Dispersion-1 and 0.5 ml of HAR1 Hardener solution were added. The resulting formulation was coated at 183 g/$m^2$ onto a 0.178 mm gelatin-subbed clear poly(ethylene terephthalate) support. The resulting imaging coating had the following dry component coverage given in g/$m^2$: 14.2 of gelatin, 0.61 of C-1, 0.69 of M-1, 2.04 of Y-1, 5.74 of CDA-1, and 5.70 of Oxidizing Agent 1. After drying and hardening the layer for 24 hours, the coated material was cut into 35 mm strips (samples) and processed in a thermal processor at 160° C. for 18 seconds. The sensitometric results are shown in TABLE I below.

EXAMPLES 2-3 (INVENTION)

To a quantity of deionized water sufficient to give the total formulation a weight of 23.6 g were added, with stirring and at 40° C., 1.24 g of oxidized deionized bone gelatin, 1.58 g of Cyan-1 Coupler Dispersion, 1.30 g of Magenta-1 Coupler Dispersion, 1.90 g of Yellow-1 Coupler Dispersion, 5.55 g of Dispersion-1, and 0.2 ml of 6.8 weight % SDS solution. The resulting mixture was adjusted to pH 7.0 with a sodium hydroxide solution. Just prior to coating the formulations, 3.66 g of Oxidizing Agent 2 Dispersion or 2.68 g of Oxidizing Agent 3 Dispersion (see TABLE I below) and 0.5 ml of HAR1 Hardener solution were added. The formulations were coated at 183 g/m$^2$ onto 0.178 mm gelatin-subbed poly(ethylene terephthalate) clear support. The resulting coatings had the following coverage given in g/m$^2$: 14.0 of gelatin, 0.61 of C-1, 0.68 of M-1, 1.31 of Y-1, 5.62 of CDA-1, and Oxidizing Agent 2 or 3 as shown in TABLE I below. After drying and hardening for 24 hours, the coatings were cut into 35 mm strips and processed in a thermal processor at 160° C. for 18 seconds. The sensitometric results are shown in TABLE I below.

EXAMPLES 4–5 (INVENTION)

Thermographic films of this invention were prepared for these examples similarly to those of Invention Examples 2–3 except that 1 g of SA Dispersion was added after Dispersion 1. The results are shown in TABLE I below.

EXAMPLE 6 (COMPARATIVE)

A thermographic film outside of the present invention was prepared similarly to those of Invention Examples 4–5 except that sodium persulfate was used in place of the benzoquinone oxidizing agent.

EXAMPLES 7–9 (COMPARATIVES)

Thermographic films outside of the present invention were prepared similarly to that of Invention Examples 4–5 except that different oxidizing agents and amounts were used as shown in TABLE I below, and the formulations were coated at 88 g/m$^2$.

EXAMPLES 10–12 (COMPARATIVES)

Thermographic films outside of the present invention were prepared similarly to that of Invention Examples 4–5 except that different oxidizing agents and amounts were used as shown in TABLE I below.

EXAMPLE 13 (COMPARATIVE)

A thermographic film outside of the present invention was prepared similarly to that of Invention Examples 4–5 except that water was added in place of the benzoquinone oxidizing agent.

TABLE I (Samples Processed at 160° C. for 18 seconds)

| Example | Oxidizing Agent (g/m$^2$) | SA (g/m$^2$) | Densities before Processing Red, Green, Blue | Densities after Processing Red, Green, Blue | Average Density after Processing and (spread) |
|---|---|---|---|---|---|
| Invention Example 1 | Oxidizing Agent 1 5.70 | 0 | 0.07, 0.13, 0.23 | 2.12, 2.15, 1.78 | 2.02 (0.37) |
| Invention Example 2 | Oxidizing Agent 2 3.32 | 0 | 0.08, 0.12, 0.21 | 0.55, 0.72, 0.72 | 0.66 (0.17) |
| Invention Example 3 | Oxidizing Agent 3 2.27 | 0 | 0.12, 0.22, 0.83* | 0.86, 1.30, 1.20 | 1.12 (0.44) |
| Invention Example 4 | Oxidizing Agent 2 3.32 | 1.92 | 0.12, 0.18, 0.29 | 0.72, 0.72, 0.72 | 0.72 (0) |
| Invention Example 5 | Oxidizing Agent 3 2.27 | 1.92 | 0.15, 0.29, 0.96* | 1.41, 1.64, 1.48 | 1.51 (0.23) |
| Comparative Example 6 | Sodium persulfate 4.65 | 1.92 | 0.13, 0.21, 0.31 | 0.19, 0.38, 0.47 | 0.35 (0.28) |
| Comparative Example 7 | Barium peroxide 2.27 | 0.93 | 0.18, 0.08, 0.13 | 0.22, 0.21, 0.33 | 0.25 (0.12) |
| Comparative Example 8 | Cobalt (III) hexamine trichloride 2.27 | 0.93 | 0.07, 0.13, 0.23 | 0.14, 0.30, 0.27 | 0.24 (0.16) |
| Comparative Example 9 | Sodium persulfate 2.27 | 0.93 | 0.10, 0.18, 0.22 | 0.10, 0.19, 0.20 | 0.16 (0.10) |
| Comparative Example 10 | Phthalazine N-oxide 3.90 | 1.92 | 0.11, 0.21, 0.25 | 0.19, 0.27, 0.56 | 0.34 (0.37) |
| Comparative Example 11 | 4-Picoline N-oxide 2.91 | 1.92 | 0.05, 0.11, 0.12 | 0.16, 0.20, 0.30 | 0.22 (0.14) |
| Comparative Example 12 | 2-Picoline N-oxide 2.91 | 1.92 | 0.05, 0.11, 0.14 | 0.14, 0.17, 0.25 | 0.19 (0.11) |
| Comparative Example 13 | None | 1.92 | 0.07, 0.10, 0.14 | 0.21, 0.24, 0.28 | 0.24 (0.07) |

*The $D_{min}$ was increased because Oxidizing Agent 3 is highly colored.

The results in TABLE I show that the Invention materials exhibited relatively low density prior to thermal imaging-development and increased image density thereafter. However, the Comparative materials showed poor densities after imaging-development.

The red, green, and blue densities given in TABLE I show that all of the Invention film samples produced dark and near neutral image tones. Because this invention does not rely on silver metal (known to give unpredictable yellow tone shifts) to make up the image density, the image tone is easily and predictably adjusted by changes in the ratio of the cyan, magenta, and yellow dye-forming color couplers once their relative reactivities and dye color densities have been determined through routine test coatings.

The invention has been described in detail with particular reference to certain preferred embodiments thereof, but it will be understood that variations and modifications can be effected within the spirit and scope of the invention.

The invention claimed is:

1. A silver-free, black-and-white thermographic material comprising a support having thereon at least one imaging layer comprising predominantly a hydrophilic or water-dispersible polymeric latex binder, and further comprising:

a) a color developing agent precursor that releases a color developing agent when heated to a temperature of at least 80° C., and b) a cyan dye-forming color coupler that is capable of reacting with said released color developing agent to produce a cyan dye, c) a magenta dye-forming color coupler that is capable of reacting with said released color developing agent to produce a magenta dye, d) a yellow dye-forming color coupler that is capable of reacting with said released color developing agent to produce a yellow dye, and e) an oxidizing agent that is a benzoquinone that is capable of oxidizing the released color developing agent, said material being substantially free of silver metal or reducible silver ions.

2. The material of claim 1 wherein said oxidizing agent is represented by the following Structure I:

(I)

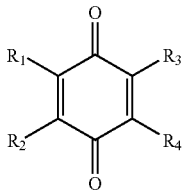

wherein $R_1$, $R_2$, $R_3$, and $R_4$ are independently hydrogen, or electron accepting or electron withdrawing groups.

3. The material of claim 2 wherein $R_1$, $R_2$, $R_3$, and $R_4$ are independently hydrogen, substituted or unsubstituted alkyl groups, substituted or unsubstituted aryl groups, substituted or unsubstituted cycloalkyl groups, substituted or unsubstituted alkoxy or aryloxy groups, cyano, halo, sulfo, sulfonamido, carbonamido, or carboxy groups, or either $R_1$ and $R_2$ or $R_3$ and $R_4$ can be combined to form a carbocyclic or heterocyclic ring.

4. The material of claim 3 wherein $R_1$, $R_2$, $R_3$, and $R_4$ are independently hydrogen, substituted or unsubstituted alkyl groups having 1 to 4 carbon atoms, substituted or unsubstituted cyclohexyl groups, substituted or unsubstituted phenyl groups, or halo groups.

5. The material of claim 1 wherein said oxidizing agent is benzoquinone, tetrachloro-1,4-benzoquinone, 2,6-dimethoxy-1,4-benzoquinone, or 2,3,5-trichloro-6-pentadecyl-1,4-benzoquinone.

6. The material of claim 1 wherein said oxidizing agent is present in an amount of from about 0.5 to about 20 mol/mol of color developing agent precursor.

7. The material of claim 1 wherein said color developing agent precursor releases a p-phenylenediamine color developing agent upon heating to a temperature of at least 80° C.

8. The material of claim 1 wherein said color developing agent precursor is present in an amount of from about 0.0001 to about 0.1 mol/$m^2$.

9. The material of claim 1 wherein said cyan dye-forming color coupler, said magenta dye-forming color coupler, and said yellow dye-forming color coupler are independently present in an amount of from about 0.01 to about 1 mol/mol of color developing agent precursor.

10. The material of claim 1 wherein said binder is a hydrophilic binder is gelatin, a gelatin derivative, a cellulosic material, or a poly(vinyl alcohol).

11. The material of claim 1 that is duplitized, having one or more of the same or different imaging layers on both sides of said support.

12. The material of claim 1 further comprising a protective layer over said one or more imaging layers.

13. A silver-free, black-and-white, non-photosensitive thermographic material that comprises a transparent polymer support having on only one side thereof one or more thermally sensitive imaging layers and an outermost non-thermally sensitive protective layer over said one or more thermally sensitive imaging layers, said one or more thermally sensitive imaging layers comprising predominantly one or more hydrophilic binders, and in reactive association, imaging chemistry consisting essentially of:

a) a color developing agent precursor that releases a p-phenylenediamine color developing agent when heated to a temperature of at least 80° C., said color developing agent precursor being present in an amount of from about 0.001 to about 0.05 mol/$m^2$, b) a cyan dye-forming color coupler that is capable of reacting with said released color developing agent to produce a cyan dye, c) a magenta dye-forming color coupler that is capable of reacting with said released color developing agent to produce a yellow dye, d) a yellow dye-forming color coupler that is capable of reacting with said released color developing agent to produce a yellow dye, and e) an oxidizing agent that is benzoquinone, tetrachloro-1,4-benzoquinone, 2,6-dimethoxy-1,4-benzoquinone, or 2,3,5-trichloro-6-pentadecyl-1,4-benzoquinone, and is present in an amount of from about 1 to about 10 mol/mol of said color developing agent precursor, said material being substantially free of silver metal or reducible silver ions, and said cyan dye-forming color coupler, magenta dye-forming color coupler, and yellow dye-forming color coupler being independently present in an amount from about 0.05 to about 0.5 mol/mol of said color developing agent precursor.

14. The material of claim 13 wherein said hydrophilic binder is gelatin or a derivative thereof, a cellulosic material, or a poly(vinyl alcohol).

15. A method comprising imaging the thermographic material of claim 1 with a thermal imaging source to provide a visible image.

16. A method comprising imaging the thermographic material of claim 14 with a thermal imaging source to provide a visible image.

17. The method of claim 15 wherein said imaging is carried out using a thermal print head or a laser.

18. The method of claim 15 further comprising using said imaged thermographic material for medical diagnostic purposes.

* * * * *